US007918312B2

(12) United States Patent
Carlson

(10) Patent No.: US 7,918,312 B2
(45) Date of Patent: Apr. 5, 2011

(54) ACOUSTIC REFLECTIVE PANEL ASSEMBLY

(76) Inventor: Gregory L. Carlson, Bemidji, MN (US)

( * ) Notice: Subject to any disclaimer, the term of this patent is extended or adjusted under 35 U.S.C. 154(b) by 306 days.

(21) Appl. No.: 12/215,446

(22) Filed: Jun. 27, 2008

(65) Prior Publication Data

US 2009/0000219 A1 Jan. 1, 2009

Related U.S. Application Data

(60) Provisional application No. 60/937,767, filed on Jun. 29, 2007.

(51) Int. Cl.
*E04B 1/343* (2006.01)

(52) U.S. Cl. ..... 181/287; 181/30; 52/144; 52/145

(58) Field of Classification Search ..... 181/287, 181/30; 52/144, 145
See application file for complete search history.

(56) References Cited

U.S. PATENT DOCUMENTS

| | | | | |
|---|---|---|---|---|
| 3,232,370 | A | 2/1966 | Jaffe | |
| 3,630,309 | A | 12/1971 | Wenger et al. | |
| 4,047,337 | A * | 9/1977 | Bergstrom | 52/71 |
| 4,515,238 | A | 5/1985 | Baker | |
| 5,403,979 | A | 4/1995 | Rogers et al. | |
| 5,525,766 | A * | 6/1996 | Atcheson et al. | 181/30 |
| 5,651,405 | A | 7/1997 | Boeddeker et al. | |
| 6,085,861 | A | 7/2000 | Jones | |
| 7,503,428 | B1 * | 3/2009 | Johnson | 181/290 |
| 2004/0159753 | A1 * | 8/2004 | LaMotte | 248/165 |
| 2005/0186392 | A1 * | 8/2005 | Fontaine | 428/131 |
| 2006/0060420 | A1 | 3/2006 | Freihelt | |

* cited by examiner

*Primary Examiner* — Elvin G Enad
*Assistant Examiner* — Forrest M Phillips
(74) *Attorney, Agent, or Firm* — Richard John Bartz

(57) ABSTRACT

A portable acoustic reflective panel assembly used as a background for outdoor performances has an upright frame surrounding a sound reflecting sheet member. A plurality of elastic cords secure the sheet member to the frame. Braces connected to the frame and anchored to the ground maintain the frame and sheet member in upright positions on the ground.

17 Claims, 5 Drawing Sheets

ACOUSTIC REFLECTIVE PANEL ASSEMBLY

CROSS REFERENCE TO RELATED APPLICATION

This application claims the priority of U.S. Provisional Patent Application Ser. No. 60/937,767 filed Jun. 29, 2007.

FIELD OF THE INVENTION

The invention is in the technology of audible sound reflecting structures. The structures are portable acoustic panel assemblies used as a band, orchestra, chorus and dramatic background shells in a stage areas.

BACKGROUND OF THE INVENTION

The quality of a musical performance out of doors is diminished if a background sound reflecting structure is not employed to direct the sound toward the listening audience. Portable sound enhancing panel structures are known to amplify and project sound from bands, orchestras or choral performers outwardly toward a listening audience. The panel structure when used for outdoor performances capture and redirect the upwardly directed sound back to the performers and forward to the listening audience. An example of a portable acoustic panel structure, disclosed by J. C. Jaffe in U.S. Pat. No. 3,232,370, has panels hinged together to provide an upright shell. Upright legs connected to wheels support the panels above a floor. The prior art acoustic shells are complex structures which are heavy and awkward to move around once they are assembled. Casters and wheels used to roll the shells to selected locations on hard surfaces are unsuitable for outdoor use on soft ground and grass lawns. There is a need for a portable, low cost and lightweight acoustic panel assembly that is adapted for use in outdoor locations.

SUMMARY OF THE INVENTION

The acoustic reflective panel structure of the invention is a panel assembly that is portable, lightweight, low cost and readily assembled and disassembled. The disassembled panel assembly is movable and storable in a compact location. The panel assembly is suitable for outdoor performance use on locations including lawns, soft earth, concrete floors and stage platforms. The panel assembly has an upright frame surrounding a flexible sheet member that functions as an audible sound reflecting shell. The panel assembly also is a visual shield masting background environments thereby enhancing visual and sound created by music, actors and dance performers. Flexible elastic cords connects the sheet member to the frame. The cords are under tension to bias the sheet member laterally and vertically to maintain the sheet member taut in a flat condition surrounded by the frame. The taut sheet member does not generate noise as it does not flap in wind. Braces connected to the frame and a support surface maintain the panel assembly in its upright position. The panel assembly is used with a group of side-by-side identical panel assemblies to provide an acoustic reflective background shell for performing arts performances.

DETAILED DESCRIPTION OF THE INVENTION

In the following detailed description of the acoustic reflective panel assembly, reference is made to the accompanying drawing that form a part hereof. It is to be understood that other embodiments of the acoustic reflective panel assembly may be utilized and structural changes may be made without departing from the scope of the invention.

Figure 1:
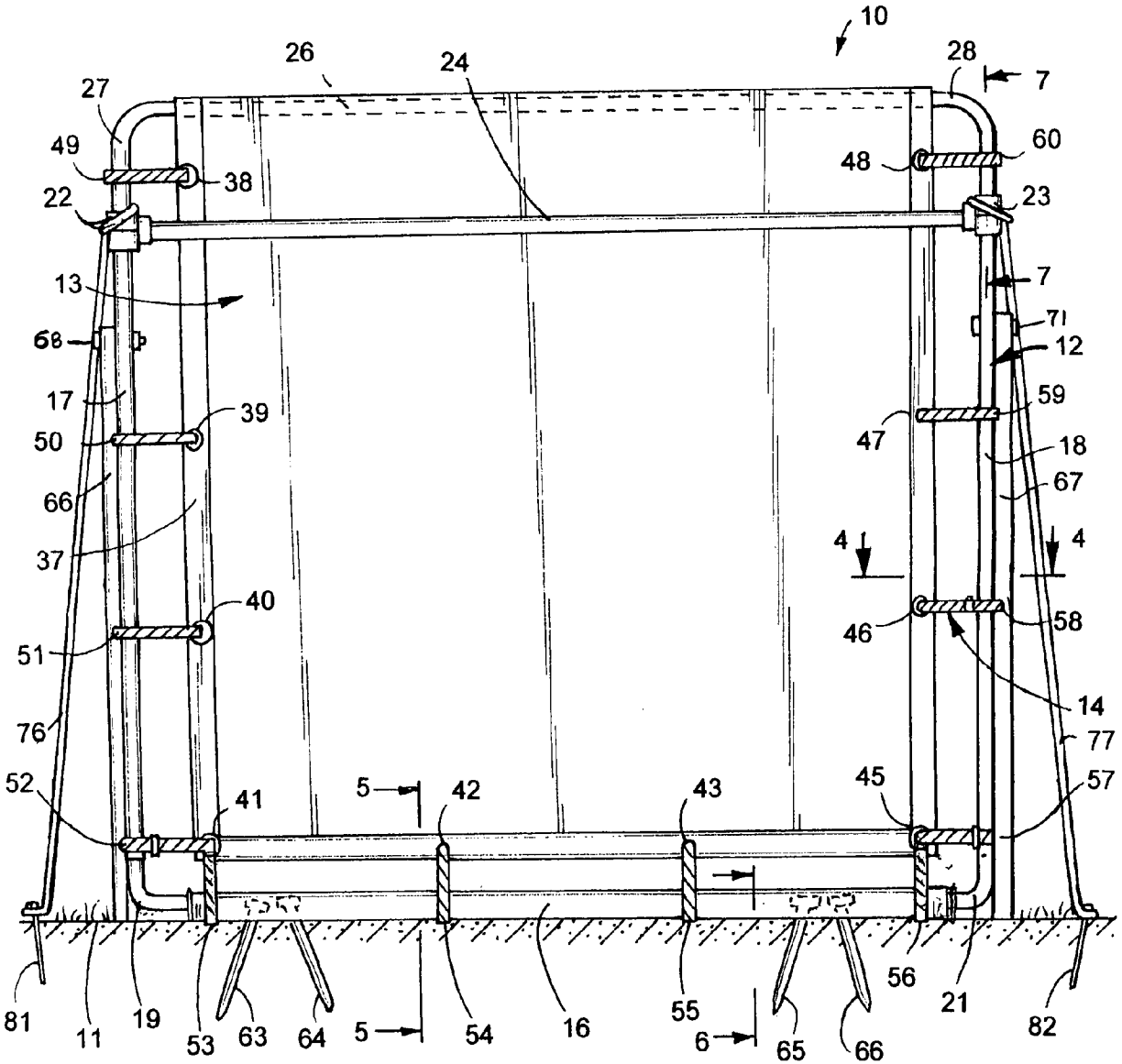
FIG. 1 is a front elevational view of the acoustic reflective panel assembly of the invention.
Figure 2:
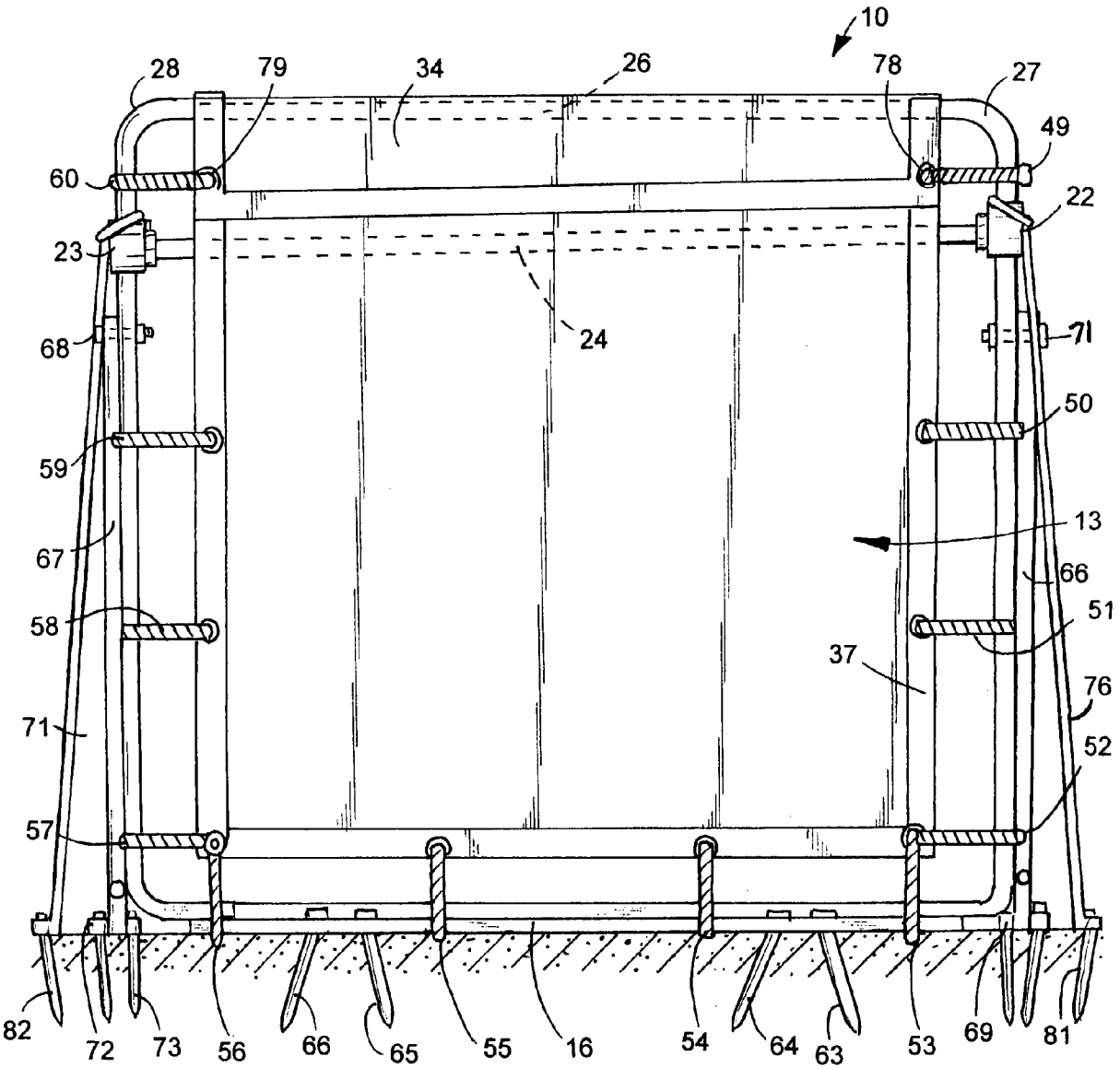
FIG. 2 is a rear elevational view thereof.
Figure 3:
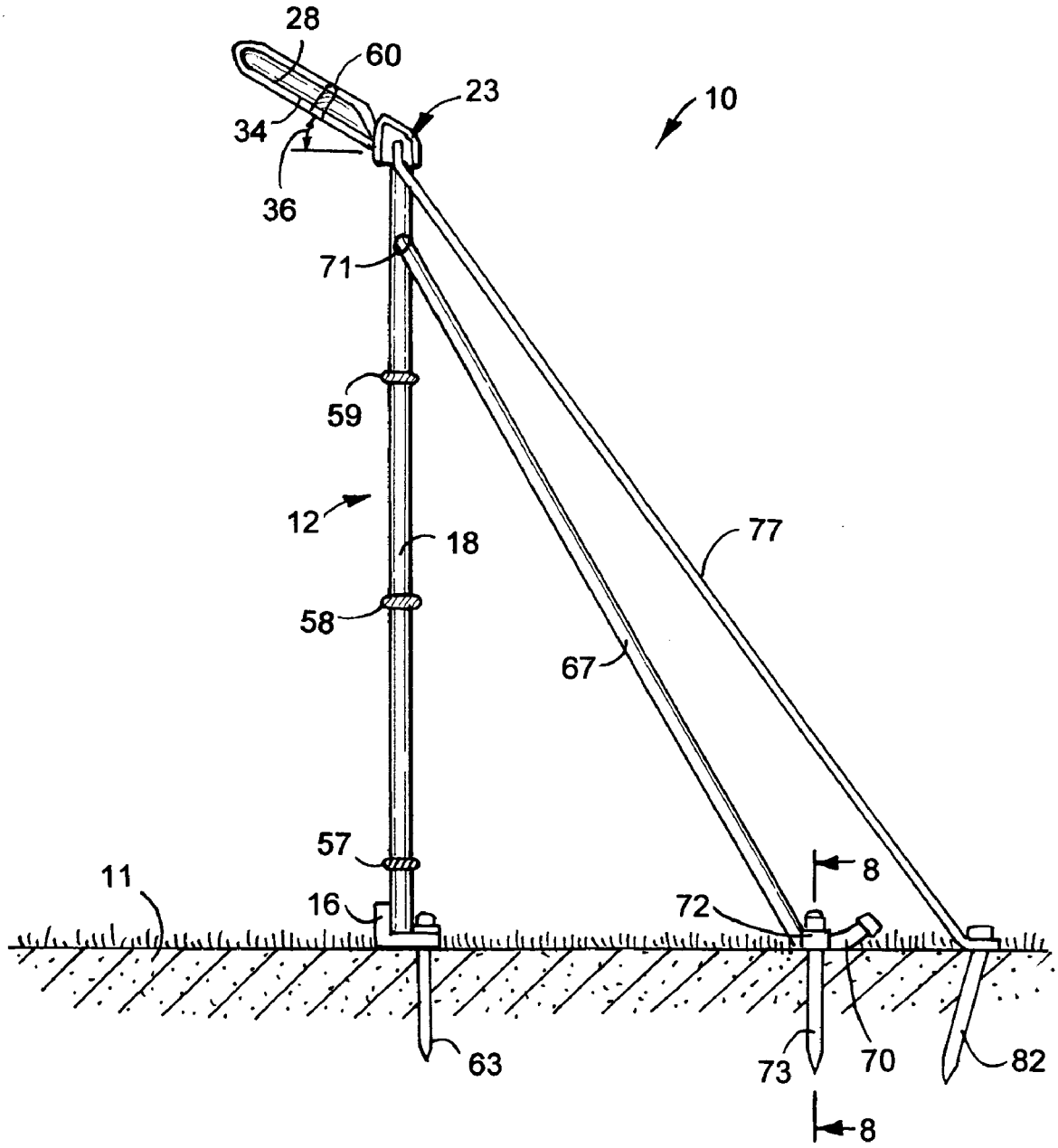
FIG. 3 is a side elevational view thereof.

The acoustic reflective panel structure of the invention, shown in FIGS. 1 to 3, has a panel assembly 10 supported in an upright position on ground 11, such as a lawn. Other supports, including but not limited to floors, decks, stages and platforms, can be used to hold the panel assembly. Panel assembly 10 includes an upright frame 12 surrounding an audible sound reflecting member 13. A plurality of elastic members 14 secure member 13 to frame 12 and hold member under tension on frame 12. A plurality of panel assemblies are used to provide an audible sound shell that directs the sound from a stage area toward an audience environment. Examples of panel assembly arrangements are diagrammatically shown in FIGS. 9 and 10.

Frame 12, shown in FIGS. 1 to 3, has a horizontal base member 16, shown as a right angle linear metal bar, resting on the surface of ground 11. Upright side members 17 and 18 are connected to opposite ends of base member 16 with curved elbows 19 and 21. The upper ends of side members 17 and 18 are connected to couplings 22 and 23. A horizontal member 24 extended across the upper portion of audible sound reflecting member 13 has opposite ends joined to couplings 22 and 23. A horizontal top member 26 is connected to couplings 22 and 23 with curved elbows 27 and 28. Members 24 and 26 are substantially parallel to base member 16. Side members 17 and 18, horizontal members 24 and 26 and elbows 19, 21, 27 and 28 are metal tubes telescopically connected together. Other materials, such as plastic tubes or rods, can be used for frame 12. Releasable fasteners, U-bolts and clamps can be used to connected elbows 19, 21, 27 and 28 to side members 17 and 18 and horizontal members 24 and 26.

Figure 7:
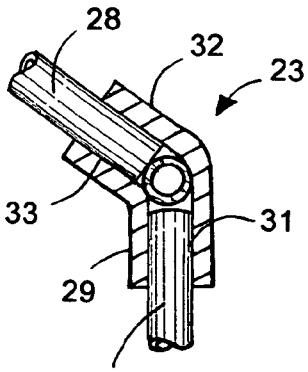
FIG. 7 is an enlarged sectional view taken along line 7-7 of FIG. 1.

As shown in FIG. 7, elbow 23 has a downwardly extended section 29 with a cylindrical pocket 31. The upper end of side member 18 telescoped into pocket 31 connects side member 18 to coupling 23. Section 29 is joined to upwardly and forwardly extended section 32 having a cylindrical pocket 33. The lower end or elbow 28 is telescoped into pocket 33 to join elbow 28 to connect elbow 28 to coupling 23. Coupling 22 has the same structure as coupling 23. Couplings 22 and 23 each have horizontal blind holes accommodating opposite ends of horizontal member 24. Couplings 22 and 23 and elbows 19, 21, 27 and 28 allow frame 23 to be knocked down into generally linear members to facilitate transport and storage of panel assembly 10. As shown in FIG. 3, coupling 23 positions elbow 28 and upper section 34 of member 13 at an upward and forward projected angle 36 relative to the vertical plane of member 13 surrounded by frame 12. A 45-degree angle is an example of angle 36. Other angles can be used for upper section 34 of sound reflecting member 13.

Figure 4:
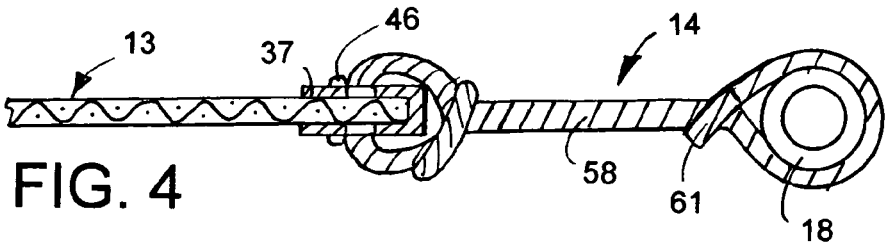
FIG. 4 is an enlarged sectional view taken along the line 4-4 of FIG. 1.
Figure 5:
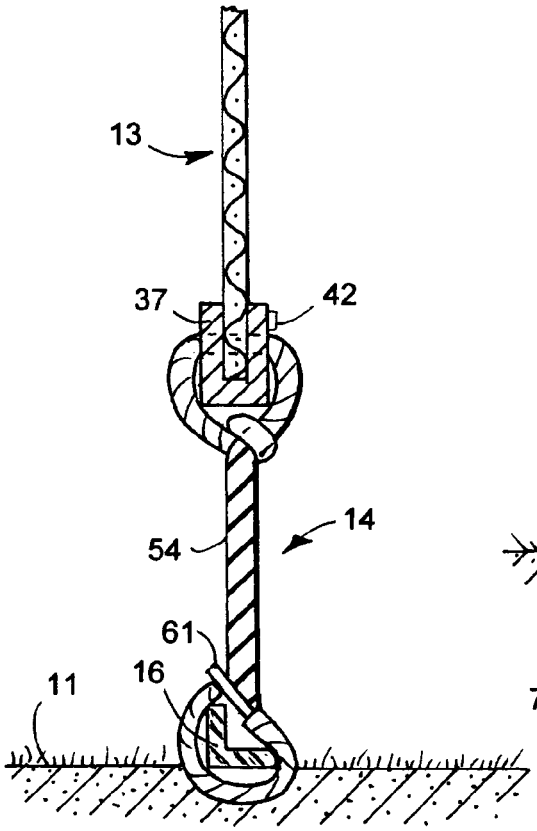
FIG. 5 is an enlarged sectional view taken along the line 5-5 of FIG. 1.

Sound reflecting member 13 comprises a flat generally rectangular air impervious sheet material. The sheet material is flexible plastic sheet member with ultraviolet resistant properties. An example of the sheet material is a fiber reinforced polypropylene plastic. Other types of plastic and fiber materials can be used for sound reflecting member 13. Member 13 has a border 37 with eyelets 38 to 48 spaced along the sides and bottom of border 37. Elastic members indicated generally at 14, comprise a plurality of elastic rubber or plastic cords 49 to 60. Cords 49 to 60 have first ends extended through eyelets 38 to 48 and fastened to border 37 with knots. Hooks connected to the first ends of cords 49 to 60 can be attached to eyelets 38 to 48. The second ends of cords 49 to 52 and 57 to 60 extended around side members 17 and 18 and elbows 27 and 28. A hook 61 on the second ends of each cord 49 to 60 retains cords 49 to 60 attached to side member 17 and 18 and base member 16. Hook 61, as shown in FIG. 4, extends over cord 58 to hold the second end of cord 58 about side member 18. As shown in FIG. 5, cord 54 has a second end extended around base member 16. Cords 49 to 60 space sound reflecting member 13 inwardly from base member 16 and side members 17 and 18 to allow air to flow around member 13. Cords 49 to 60 are stretched to place them in tension. This places an opposite outward and downward biasing force on member 13 and maintains member 13 within the upright plane of frame 12. The biasing cords 49 to 60 absorbs wind pressure and reduces flap of member 13 in a wind. The taut sound reflecting member 13 has minimal movements when subjected to flowing air whereby member 13 produces no undesirable noise.

Figure 6:
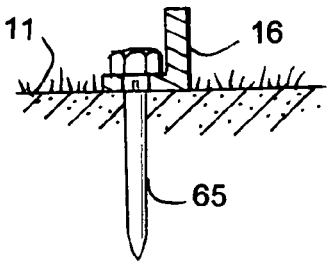
FIG. 6 is an enlarged sectional view taken along the line 6-6 of FIG. 1.

As shown in FIGS. 1, 2 and 6, a plurality of spikes 62, 63, 64 and 65 anchor base member 16 to ground 11. Spikes 62 to 65 extend through holes in base member 16 and project downwardly into ground 11. Spikes 62 to 65 can be extracted upwardly out of ground 11 to allow base member 16 and panel assembly 10 to be transported, stored or moved to a new location.

Figure 8:
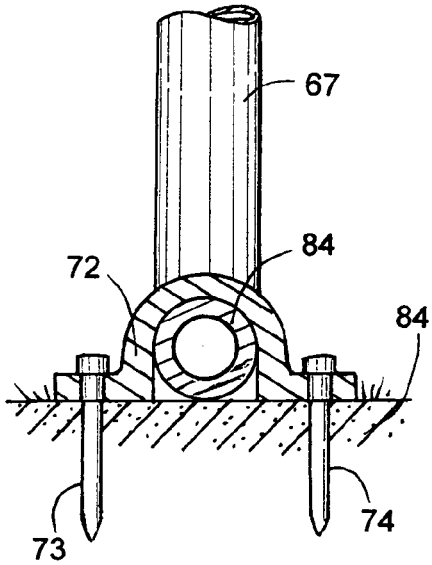
FIG. 8 is an enlarged sectional view taken along the line 8-8 of FIG. 3.

Frame 12 and member 13 are maintained in upright positions by a pair of braces 66 and 67 connected to side members 17 and 18 are anchored to ground 11 rearward of base member 16. A bolt 68 pivotally connects the upper end of brace 66 to side member 17. Brace 66 extends downwardly and rearwardly to an anchor 69 attached to ground 11. The upper end of brace 67, shown in FIG. 3, is connected with bolt 71 to side member 18 and secured to ground 11 with an anchor 72. As shown in FIG. 8, anchor 72 is an inverted U-shaped member attached to ground 11 with spikes 73 and 74. The lower ends 70 of braces 66 and 67 are curved upwardly to prevent forward and rearward movements of braces 66 and 67. Anchors 69 and 72 extended over the middle of the curved lower ends 70 of braces 66 and 67 retain ends 70 in engagement with ground 11 and inhibit movement of ends 70 relative to ground 11.

As shown in FIGS. 2 and 3, the upper section 34 of audible sound reflecting member 13 extends over top frame member 26 and downwardly adjacent the back of member 13. A pair of guy ropes 76 and 77 connected to couplings 22 and 23 and anchored to ground 11 with spikes 81 and 82 maintain frame 12 and member 13 in vertical alignment and retain end 34 of frame member 26. Guy ropes 76 and 77 limit lateral and forward movements of frame 12 and member 13.

Figure 9:
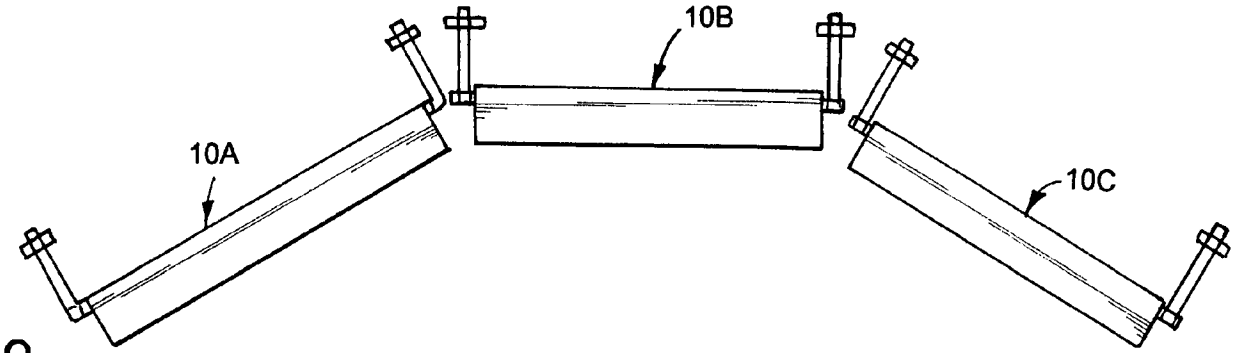
FIG. 9 is a plan diagrammatic view of a small group arrangement of acoustic reflective panel assemblies of the invention.
Figure 10:
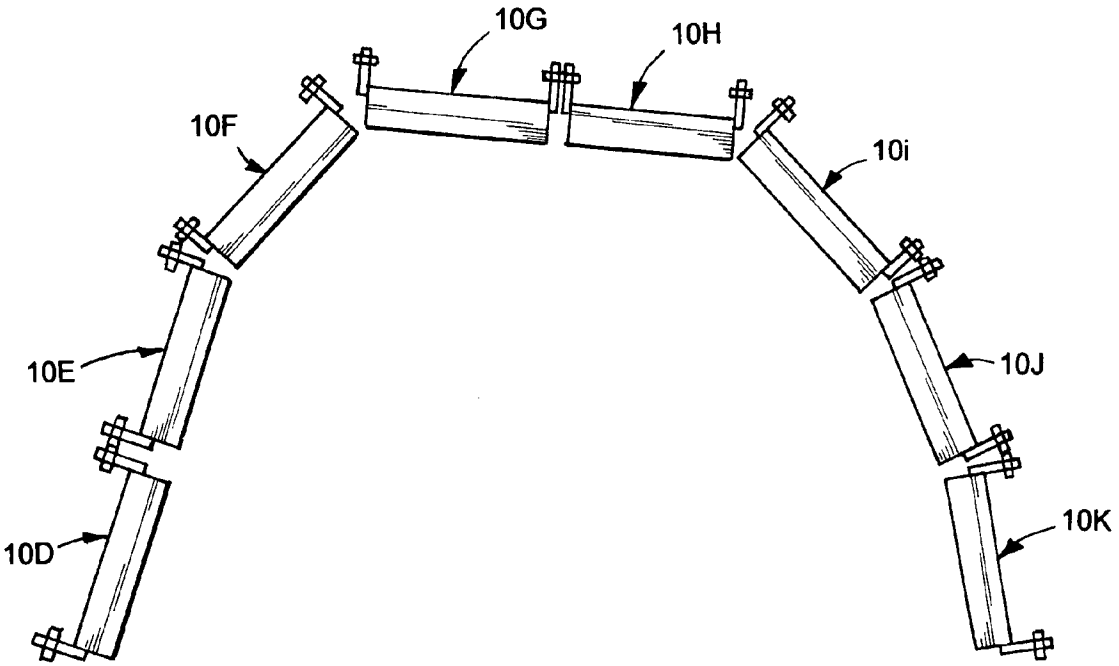
FIG. 10 is a plan diagrammatic view of a large band or orchestra arrangement of acoustic reflective panel assemblies of the invention.

Panel assembly 10 can be used in a number of arrangements behind an individual performer, a politician or a group of performers to direct sound to outdoor audiences. The number and angular orientation of panel assemblies can be selected to enhance the quality of the audio and visual experience of the audiences. A group of three panel assemblies 10A, 10B and 10C, shown in FIG. 9, is used for an individual or small group of performers. A group of eight panel assemblies 10D to 10K, shown in FIG. 10, is used for a large group of performers, such as a band, orchestra or choral arrangements. Adjacent panel assemblies are separated from each other to allow air to flow between the panel assemblies to reduce wind stress on the panel assemblies without reducing the acoustic reflecting characteristics of the panel assemblies.

The panel assembly of the invention has been described with respect to a particular embodiment thereof. It is appreciated and understood that variation and modifications of the size, materials, and parts of the panel assembly can be made by persons skilled in the art without departing from the scope of the invention defined in the appended claims.

The invention claimed is:

1. An acoustic panel assembly to reflect sound to an audience comprising:

a frame having a horizontal base member, upright side members having upper ends, a cross member connected to the upper ends of the side members, and a top horizontal member located above and forwardly of the cross member, a flexible sheet member located above the base member and between the upright members, said flexible sheet member having an upper portion located over the top horizontal member and extended upwardly and forwardly from the cross member, a plurality of elastic members securing the flexible sheet member to the base member and side members of the frame, said elastic members biasing the flexible sheet member to hold the flexible sheet member in tension on the frame members, at least one brace connected to the frame for holding the frame and flexible sheet member in an upright position, a first anchor adapted to secure the brace to a support, guy members connected to an upper portion of the frame, and second anchors adapted to secure the guy members to the support to limit lateral and forward movements of the frame, brace and flexible sheet member.

2. The panel assembly of claim 1 wherein: the horizontal base member has opposite ends, said upright side members being connected to the opposite ends of the base member, couplings mounted on the upright side members, the cross member being extended between and connected to the couplings, and the top horizontal member being located above and forwardly of the cross member connected to the couplings, said sheet member being located in an upright plane between the upright side members and extended over the top horizontal member.

3. The panel assembly of claim 1 wherein: the sheet member comprises a flat, flexible and air impervious sheet member.

4. The panel assembly of claim 2 wherein: the sheet member includes an outer peripheral border and eyelets secured to said border, said elastic members being connected to said eyelets to retain the sheet member in tension on said frame.

5. The panel assembly of claim 2 including: a pair of braces for holding the frame in an upright position, and connectors attaching each brace to an upright side member of the frame.

6. The panel assembly of claim 2 wherein: the guy members connected to the upper portion of the upper side members of the frame hold the frame and the sheet member in upright positions.

7. The panel assembly of claim 1 wherein: the elastic members comprise linear elastic cords.

8. An acoustic panel assembly comprising:

a frame having upright side members and a bottom base member connected to the side members, a flat and flexible sheet member located between the side members and above the bottom base member, and a plurality of elastic cords securing the sheet member to the upright side members and bottom base member and biasing and holding the sheet member in tension between the side members of the frame.

9. The panel assembly of claim 8 including: braces connected to the upright side members for holding the frame in an upright position, anchors adapted to secure the braces to a support, and guy members connected to the upper ends of the upright side members and the support for holding the frame and flexible sheet members in an upright position.

10. The panel assembly of claim 8 wherein: the frame has a top member located upwardly and forwardly from the tops of the upright members, said sheet member having an upper portion extended upwardly and forwardly associated with the top member.

11. The panel assembly of claim 8 wherein: the sheet member includes an outer peripheral border and eyelets secured to the border, said elastic cords being connected to said eyelets to retain the sheet member in tension between the side members of said frame.

12. The panel assembly of claim 8 including: couplings mounted on the upright side members, a cross member extended across the sheet member and secured to the couplings, said frame having a top member secured to the couplings and extended upwardly and forwardly from the couplings, said sheet member having an upper portion extended over the cross member and around the top member thereby locating the upper portion of the sheet member in an upwardly and forwardly location relative to the upright side members.

13. The panel assembly of claim 12 including: the sheet member includes an outer peripheral border and eyelets secured to the border, said elastic cords being connected to said eyelets to retain the sheet member in tension on said frame.

14. The panel assembly of claim 8 including: elongated linear braces for holding the frame in an upright position, each of said braces having an upper end and an upwardly curved lower end, fasteners connecting the upper ends of the braces to the upright members, anchors adapted to hold the lower ends of the braces in fixed positions on a support, and guy members connected to upper portions of the upright members and the support for holding the frame and sheet member in an upright position.

15. An acoustic panel assembly for outdoor use to reflect sound to an audience comprising:

a frame having upright side members and a bottom member connected to the side members, said frame including a top member located upwardly and forwardly from the tops of the upright members, anchors adapted to secure the bottom member to the ground, a flat, flexible and air impervious sheet member located between the side members and above the base member, said sheet member having an upper portion extended upwardly and forwardly from the upright members and around the top member, a plurality of elastic cords securing the sheet member to the upright side members and base member and biasing and holding the sheet member in tension between the side members of the frame, a pair of elongated braces for holding the frame in an upright position, each of said braces having an upper end and an upwardly curved lower end, fasteners connecting the upper ends of the braces to the upright members, first anchors adapted to hold the lower ends of the braces in fixed positions on the ground, and guy members connected to the upper portion of the frame adopted to be anchored to the ground for holding the frame and the sheet member in upright positions.

16. The panel assembly of claim 15 wherein: the sheet member includes an outer peripheral border and eyelets secured to the border, said elastic cords being connected to said eyelets to retain the sheet member in tension on said frame.

17. The panel assembly of claim 15 including: couplings mounted on the upright side members, a cross member extended across the sheet member and secured to the couplings, said frame having a top member secured to the couplings and extended upwardly and forwardly from the couplings, said sheet member having an upper portion extended over the cross member and around the top member thereby locating the upper portion of the sheet member in an upwardly and forwardly location relative to the upright side members.

* * * * *